US012185850B1

(12) United States Patent
Kang

(10) Patent No.: US 12,185,850 B1
(45) Date of Patent: Jan. 7, 2025

(54) CROSS-LINKED SLATWALL SHELVING SYSTEM

(71) Applicant: Saeyoung Kang, Dacula, GA (US)

(72) Inventor: Saeyoung Kang, Dacula, GA (US)

( * ) Notice: Subject to any disclaimer, the term of this patent is extended or adjusted under 35 U.S.C. 154(b) by 0 days.

(21) Appl. No.: 18/205,182

(22) Filed: Jul. 5, 2023

(51) Int. Cl.
*A47F 5/08* (2006.01)
*A47F 5/00* (2006.01)

(52) U.S. Cl.
CPC ..... *A47F 5/08* (2013.01); *A47F 5/0093* (2013.01)

(58) Field of Classification Search
CPC ..... A47F 5/08; A47F 5/0093; A47F 5/0838; A47F 5/0846
USPC ..... 211/94.01; 248/223.41, 224.51; 52/36.5
See application file for complete search history.

(56) References Cited

U.S. PATENT DOCUMENTS 3,306,564 A * 2/1967 Nickel ..... A47F 5/0815 248/222.51
3,602,159 A * 8/1971 Marschak ..... A47F 5/103 211/187
4,323,163 A * 4/1982 Johns ..... A47B 96/205 52/36.5
4,461,443 A * 7/1984 Dauman ..... A47F 5/0846 211/87.01
4,607,753 A * 8/1986 Radek ..... A47F 5/0846 52/36.5
4,744,475 A * 5/1988 St. Pierre ..... A47F 5/103 403/240
4,805,783 A * 2/1989 Mayer ..... A47F 5/0846 D25/124
5,228,579 A * 7/1993 Kaufman ..... A47F 5/0846 52/36.5
5,412,912 A * 5/1995 Alves ..... A47F 5/0846 52/36.5
5,566,844 A * 10/1996 Bernardin ..... A47F 5/0846 211/208
5,607,070 A * 3/1997 Hellyer ..... A47F 5/0846 211/187
5,772,054 A * 6/1998 Potter ..... A47F 7/144 211/87.01
5,944,203 A * 8/1999 Vlah ..... A47F 5/0846 211/94.01
6,164,467 A * 12/2000 DePottey ..... A47F 5/0846 52/36.5
6,564,952 B1 * 5/2003 Suttles ..... A47F 5/01 211/187
6,951,085 B2 * 10/2005 Hodges ..... E04B 2/7425 52/239
7,270,242 B2 * 9/2007 Liu ..... A47B 47/024 248/188.8
7,571,571 B1 * 8/2009 Mershon ..... E04F 13/12 52/36.5
7,861,986 B2 * 1/2011 Cline ..... E04B 2/7416 52/36.5

(Continued)

*Primary Examiner* — Jennifer E. Novosad
(74) *Attorney, Agent, or Firm* — Young Jeon, Esq.

(57) ABSTRACT

A cross-linked slatwall shelving system where a plurality of back panels, each having four or more holes penetrating vertically through the entirety of the panels; and two or more rods, each connecting two or more panels by penetrating the holes; wherein one or more panels are penetrated by two different rods that penetrate two different sets of panels forming one or more cross-links. Cross-links reinforce the structural integrity and rigidity of the back panel of a shelving system.

4 Claims, 12 Drawing Sheets

(56) References Cited

U.S. PATENT DOCUMENTS

| | | | | |
|---|---|---|---|---|
| 7,946,435 | B2 * | 5/2011 | Clark | A47F 5/108 211/189 |
| 8,033,404 | B2 * | 10/2011 | Keller | A47F 5/0846 211/94.01 |
| 8,746,472 | B2 * | 6/2014 | Thrush | F16B 45/00 211/94.01 |
| 9,596,948 | B1 * | 3/2017 | McGinnis | A47F 5/103 |
| 10,098,479 | B1 * | 10/2018 | Muellerleile | A47F 5/103 |
| 10,905,259 | B2 * | 2/2021 | Spain, Jr. | A47F 5/083 |
| 11,517,128 | B1 * | 12/2022 | Nieto | A47B 87/0207 |
| 11,737,586 | B1 * | 8/2023 | Welker | A47B 96/1458 211/1.51 |
| 2007/0056921 | A1 * | 3/2007 | Lo | F16M 11/046 211/94.01 |
| 2007/0141946 | A1 * | 6/2007 | Sorensen | A47F 5/0815 446/118 |
| 2008/0000861 | A1 * | 1/2008 | Muellerleile | A47B 96/06 211/94.01 |
| 2023/0110104 | A1 * | 4/2023 | Ingram | A47F 5/0815 211/94.01 |

* cited by examiner

CROSS-LINKED SLATWALL SHELVING SYSTEM

TECHNICAL FIELD

The invention relates to the field of retail display and shelving system. More specifically, the invention relates to display and shelving system composed of plurality of panels. The invention further relates to a display and shelving slatwall, also known as slotwall, panels that are cross-linked via plurality of rods where each rod penetrates two or more panels and at least one panel is penetrated by two or more rods.

BACKGROUND ART

Retail stores utilize various fixtures to store and display merchandise, and because most stores can increase sales opportunities and attract more customers by increasing the variety of merchandise they carry, versatility and expandability of the fixtures are quintessential to a retail display and shelving system. For example, a versatile shelving unit can be used to store varying sizes of merchandise by adjusting numbers and heights of shelves. An example of extendable shelving unit is a gondola shelving system where you can connect any number of gondola units in a row to build any length of store aisles.

Gondola shelving is widely used to build a custom-length store aisles for any kind of retail stores by connecting single- or double-sided units in a row. Gondola shelving is typically composed of a steel base and a pegboard or slatwall backing on which multiple numbers of shelves can be quickly installed to desired heights. Slatwall backing is typically made of medium density fiberboard ("MDF"), but more durable material such as tempered hardboard and metal are used for more solid construction. Metal slatwall panels are desirable for its strength and durability, and metal fixtures made of aluminum or stainless steel can provide good appearance and resistance to rust and other deterioration due to environmental exposures. Typically, to reduce the cost of raw materials, a thin metal sheet is folded to create a slatwall panel that features bent edges, structural grooved seams, or hemmed edges to provide enough support for the shelves inserted to the slots made on or between the slatwall panels. Nonetheless, slatwall panels made of metal sheet are a lot more expensive than MDF or hardboard slatwall panels.

Gondola shelving units are typically assembled on-site, meaning the shelving units are shipped to a desired location in parts, assembled to a stand-alone shelving unit, and installed, typically in a series of multiple units, on a retail display or storage room. Most gondola shelving units have modular configuration with various comparable single- or double-sided units, including starter units, end cap units, island units, and so on. As a result, a gondola shelving system creates an aisle with various length and configuration. For example, single-sided units are designed to be installed against a wall, and double-sided units are between aisles, and end cap units can be installed at a corner of an aisle for maximum exposure of shelved merchandise. Slatwall shelving units have a raised base on which two upright posts that having multiple slots along its length are installed. When the posts are affixed on the opposite ends of the base, the slots or holes accommodate hooks or flanges attached to slatwall panels which are horizontally hung from bottom to top to cover the gap between the two posts. A desired thickness of metal structure forming slots is over one-millimeter because anything less can result in the slots deforming or breaking prematurely when shelves are hung by inserting flanges to the slots and are fully loaded with heavyweight items.

As aforementioned, having thick metal slatwall panels increases the manufacturing cost, shipping weight, and the difficulty in handling and assembly, which can substantially reduce the desirability of gondola units made of metal. There have been attempts to solve this problem by using mixed material in a partially metal structure, wherein the majority of backing is made of cheap MDF and thin metal strip is applied to slot edges, but they fail to provide the look, strength, and durability of full metal shelving units.

BRIEF SUMMARY

The invention is related to a cross-linked slatwall shelving system where a plurality of slats, each having two or more holes penetrating vertically through the entirety thereof and having one or more flanges on both ends; and two or more crossing rods, each connecting two or more slats by penetrating the holes thereof; wherein one or more slats are penetrated by two different crossing rods that penetrate two different groups of connected slats.

The slats are hung on posts installed upright on a shelving base and additionally connected together via cross-link wherein a crossing rod penetrates two or more slats and two-or-more crossing rods penetrate a slat. In this cross-liked formation, a slat is vertically joined with another slat in addition to the posts at both ends. At the same thickness, cross-linked slats can provide stronger and more durable structure than slatwall panels simply hung on two posts at both ends.

An object of the invention is providing metal slatwall backing of a display and shelving unit sufficient structural strength without adding vertical metal posts, increasing thickness of slatwall panels, or using expensive alloys, among others. By increasing the number of holes along a slat and the number of crossing rods penetrating two or more slats the slatwall can be incrementally strengthened to a desired level. The number of holes and crossing rods to be utilized, the thickness of metal slats forming a slatwall back, and their configuration can vary based on the usage and placement of shelving units, and the length of a crossing rod can be as short as the height of two slats installed. Thereby, the cross-linked slatwall can be used for any configuration and size of shelving units from short to long, from narrow to wide, and light duty to heavy duty.

DETAILED DESCRIPTION

The invention is related to a cross-linked slatwall shelving system where a plurality of slats, each having four or more holes penetrating vertically through the entirety thereof and two or more flanges on both ends; and two or more crossing rods, each connecting two or more slats by penetrating the holes thereof; wherein one or more slats are penetrated by two or more different crossing rods where one or more of the crossing rods cross-link two different groups of slats that are connected by a crossing rod.

Figure 3:
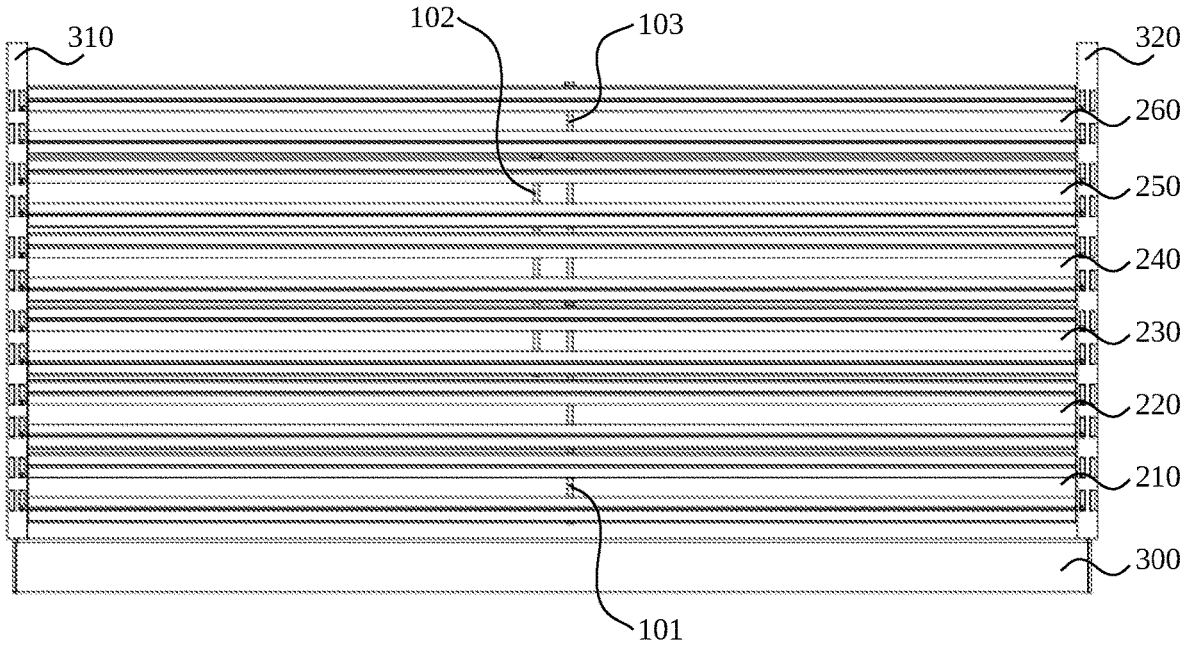
FIG. 3 is a rear view of the cross-linked slatwall shelving system shown in FIG. 1.
Figure 4:
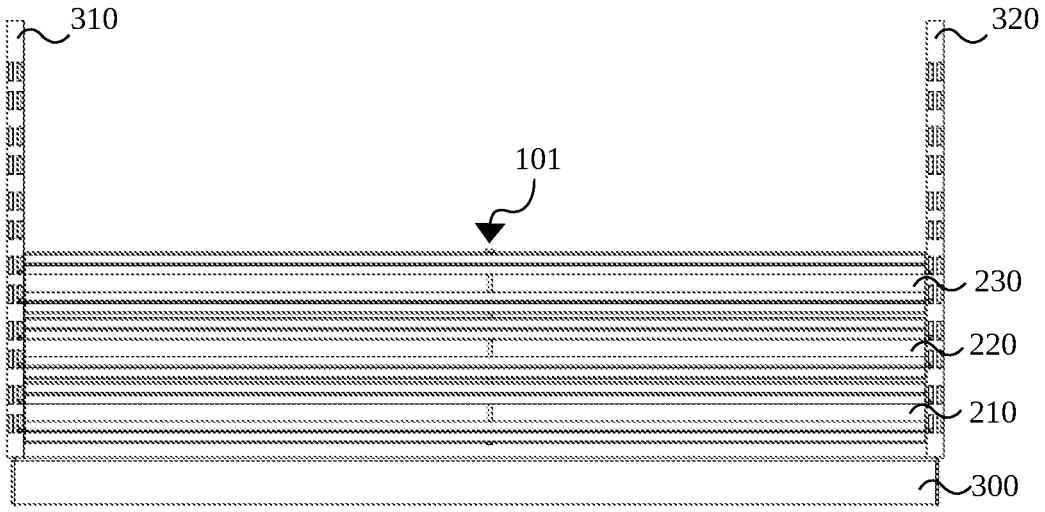
FIG. 4 is a rear view of a partially assembled cross-linked slatwall shelving system where three slats and a crossing rod are installed onto a base and posts assembly.
Figure 5:
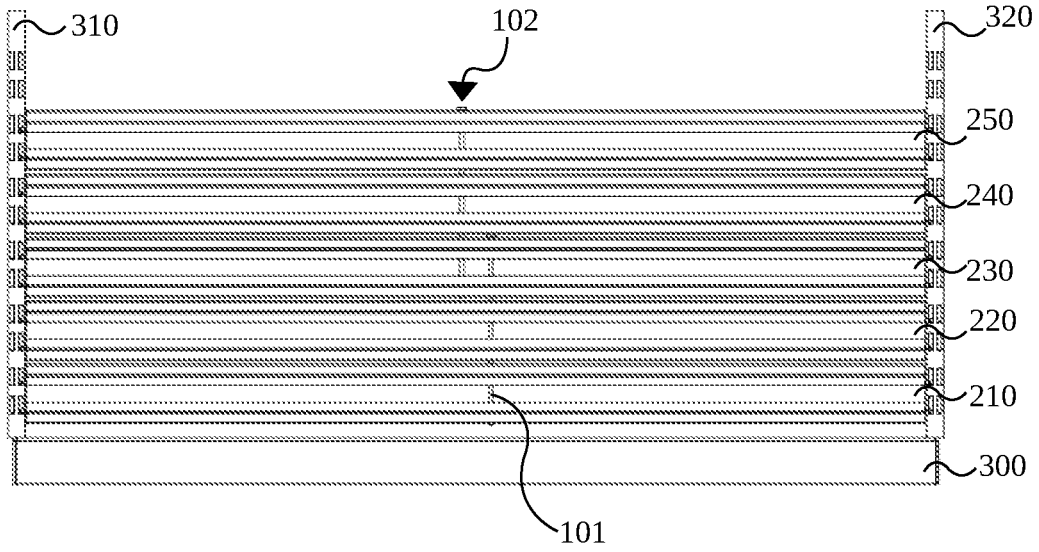
FIG. 5 is a rear view of a partially assembled cross-linked slatwall shelving system where five slats and two crossing rods are installed onto a base and posts assembly.
Figure 6:
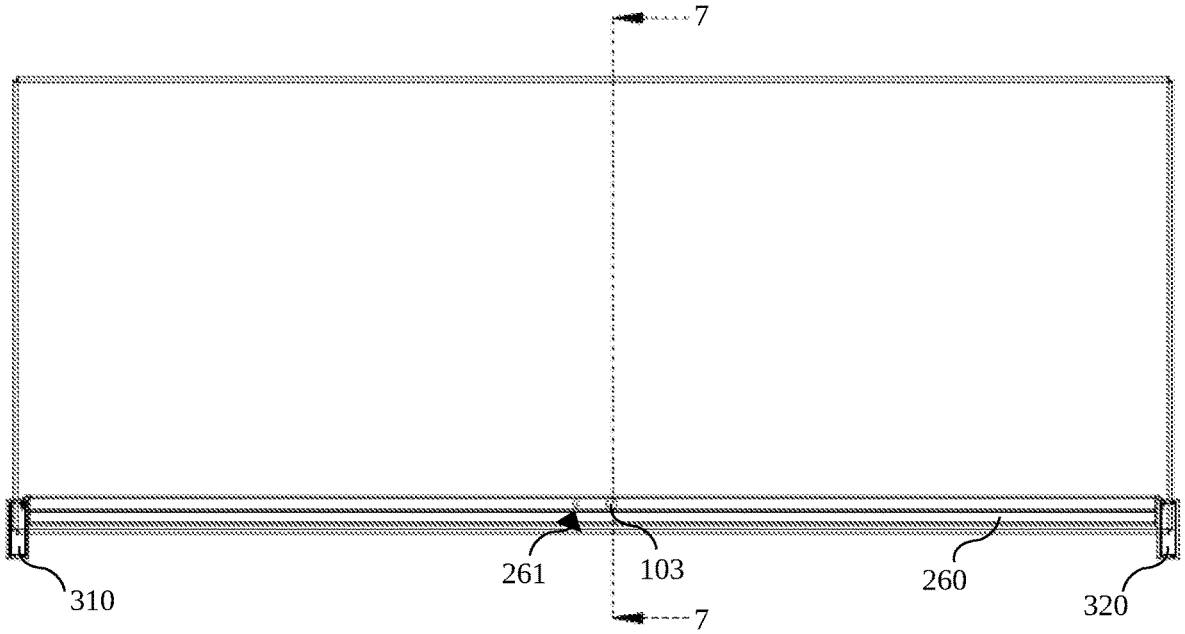
FIG. 6 is a top view of the cross-linked slatwall shelving system shown in FIG. 1.
Figure 12:
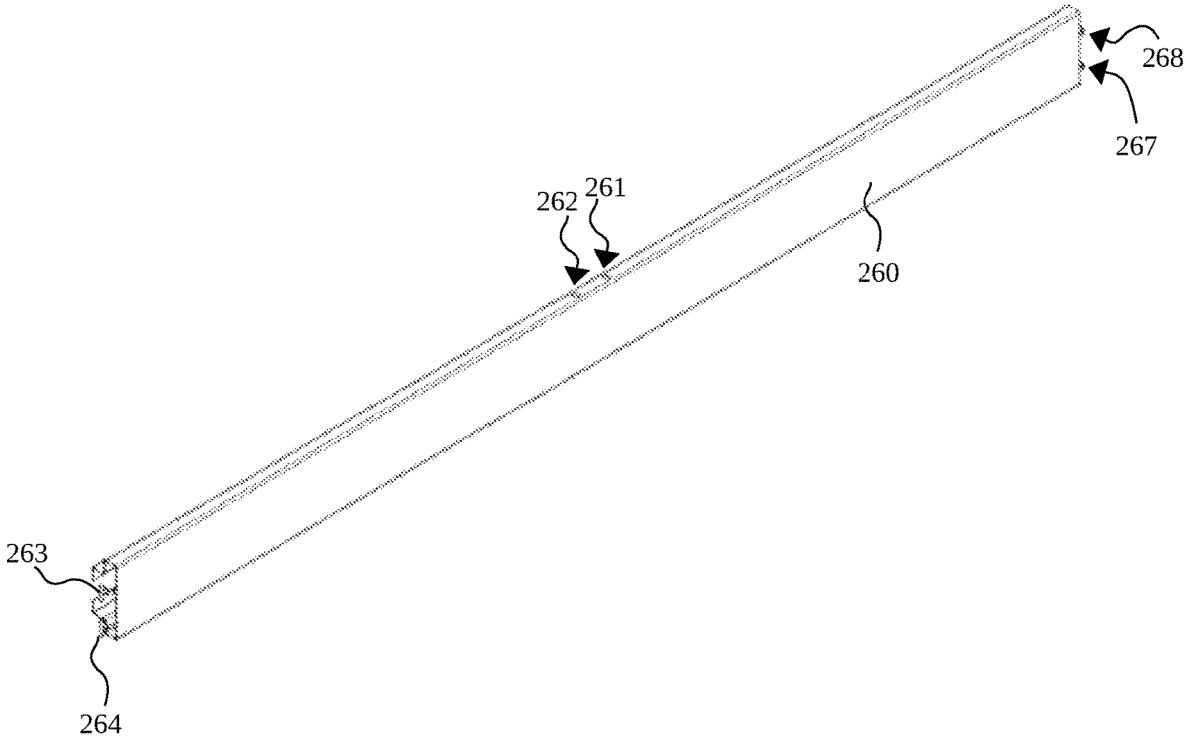
FIG. 12 is an isometric view of the top most slat of the cross-linked slatwall shelving system shown in FIG. 1.
Figure 13:
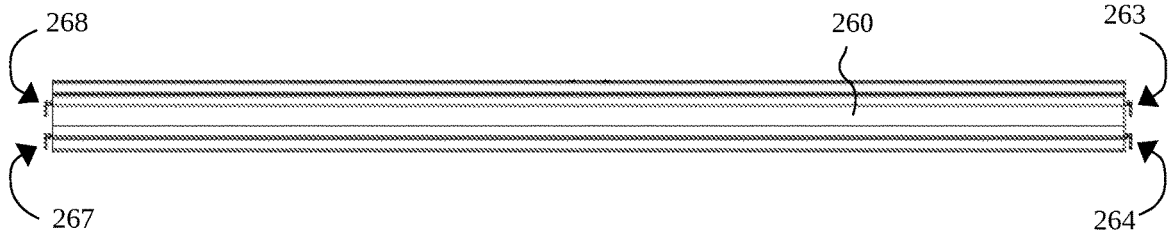
FIG. 13 is a rear view of the slat shown in FIG. 12.
Figure 14:
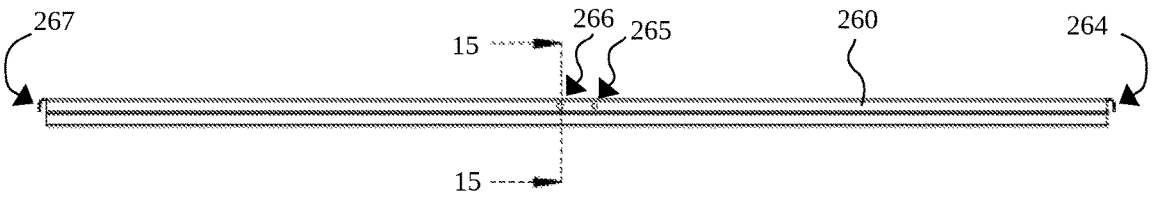
FIG. 14 is a bottom view of the slat shown in FIG. 12.
Figure 15:
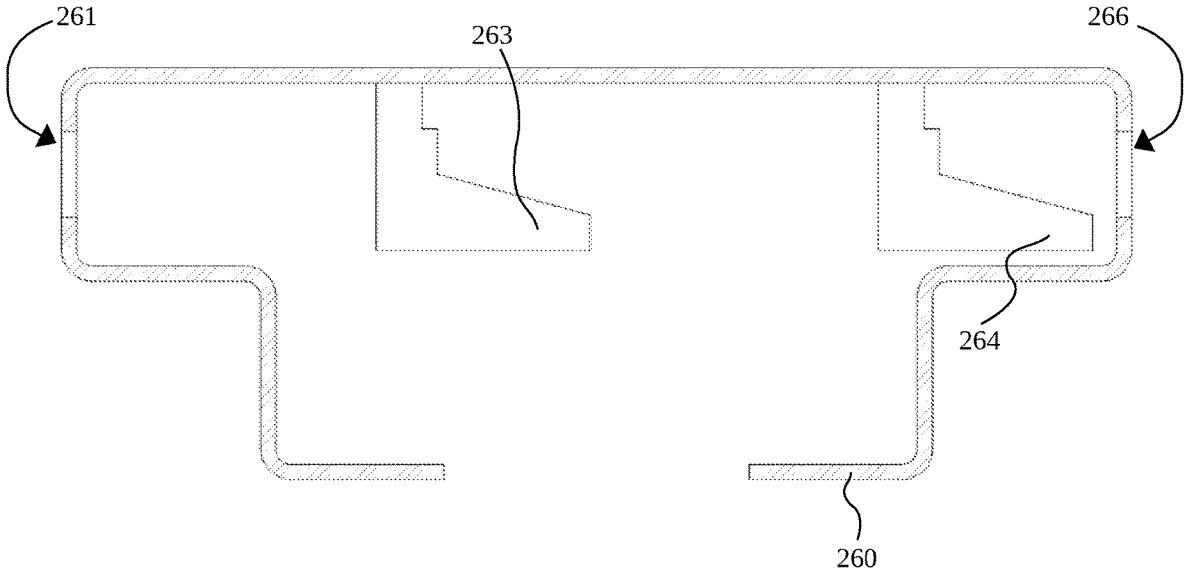
FIG. 15 is a sectional view of the slat shown in FIG. 12 from the plane shown in FIG. 14.
Figure 16:
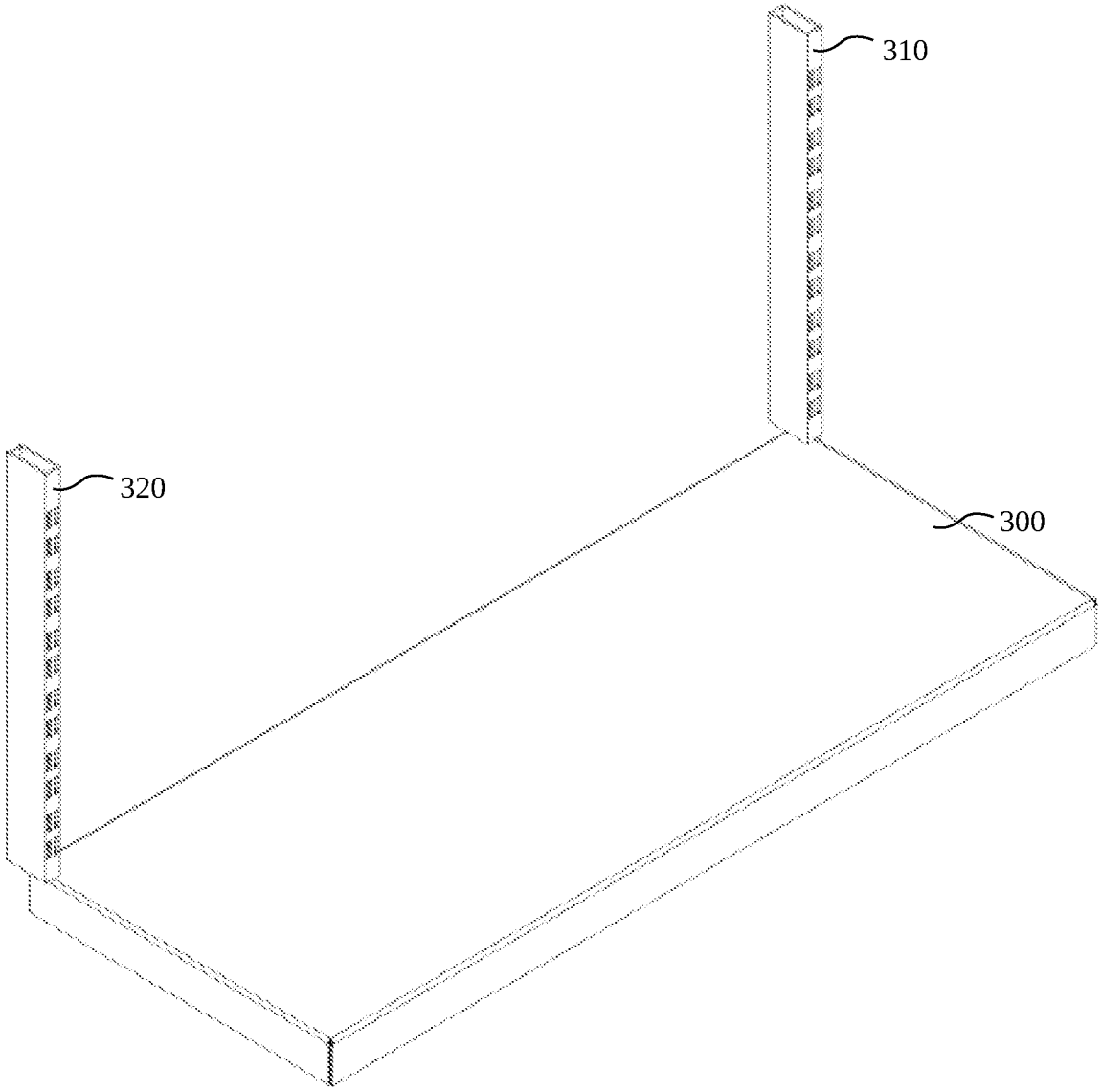
FIG. 16 is an isometric view of a base and posts assembly for a slatwall shelving system.

An embodiment of the invention is a base 300 and posts 310, 320 assembly with slats 210, 220, 230, 240, 250, 260 made of 0.8-millimeter-thick carbon sheet steel. A metal sheet is cut and folded to create slats 210, 220, 230, 240, 250, 260 with three right-angle bent lines along the length to create slats 210, 220, 230, 240, 250, 260, one of which is shown in FIG. 12 as an example. Laser perforation forms two holes 261, 262 on top side and two holes 265, 266 on the bottom side of the slat 260 so that a straight crossing rod 101, 102, 103 can penetrate the entire height of two or more slats. Both ends of a slat 260 has two flanges 263, 264, 267, 268 in a mirror image. A total of six slats 260, 250, 240, 230, 220, 210 form backing of the slatwall shelving system shown in FIG. 1, and all slats 210, 220, 230, 240, 250, 260 are identical in shape and size. Flanges 263, 264, 267, 268 are inserted into slots of the two posts 310, 320 installed upright on the shelving unit's base 300. Six slats 210, 220, 230, 240, 250, 260 are installed sequentially from bottom to top. After three slats 210, 220, 230 are installed on the posts 310, 320, a crossing rod 101 is inserted through the holes 261, 262, 265, 266 from top to bottom. A crossing rod 101, 102, 103 has a head thicker than the holes 261, 262, 265, 266 that prevents the crossing rod 101, 102, 103 from falling through the holes 261, 262, 265, 266 all the way and hit the base 300. Two more slats 240, 250 are installed, and another crossing rod 102 is inserted through another sets of holes so that the slat 230 is penetrated by both crossing rods 101, 102 as shown in FIG. 5. Another slat 260 and a crossing rod 103 are added in the same manner to complete a slatwall shelving system as shown in FIG. 3.

Another embodiment of the invention have three or more holes on top and a matching number of holes on bottom of a slat. The holes are distributed along the entirety of the length of the slat and distanced equally. Crossing rods are inserted every other hole after three slats are installed, and after additional two slats are installed another set of crossing rods are inserted to the column of holes where the first set of crossing rods are not inserted. In another embodiment, the first set of crossing rods are inserted after five slats are installed and have a length to cover the entire height of the installed five slats. The next crossing rods are inserted after additional three slats are installed. Here, two consecutive slats are penetrated by all crossing rods creating two-slat cross-links.

Figure 1:
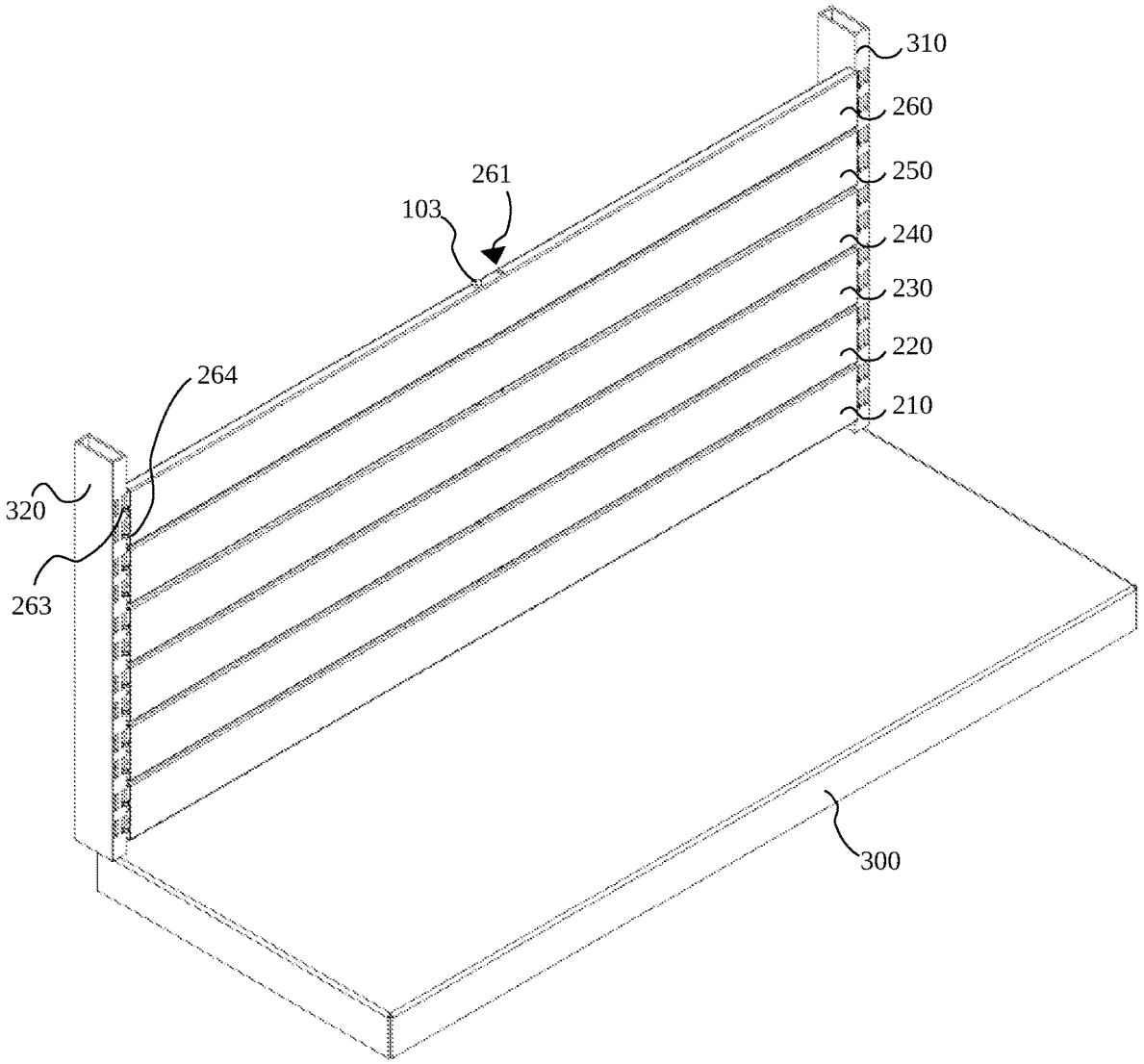
FIG. 1 is an isometric view of a cross-linked slatwall shelving system having six slats and three crossing rods.
Figure 2:
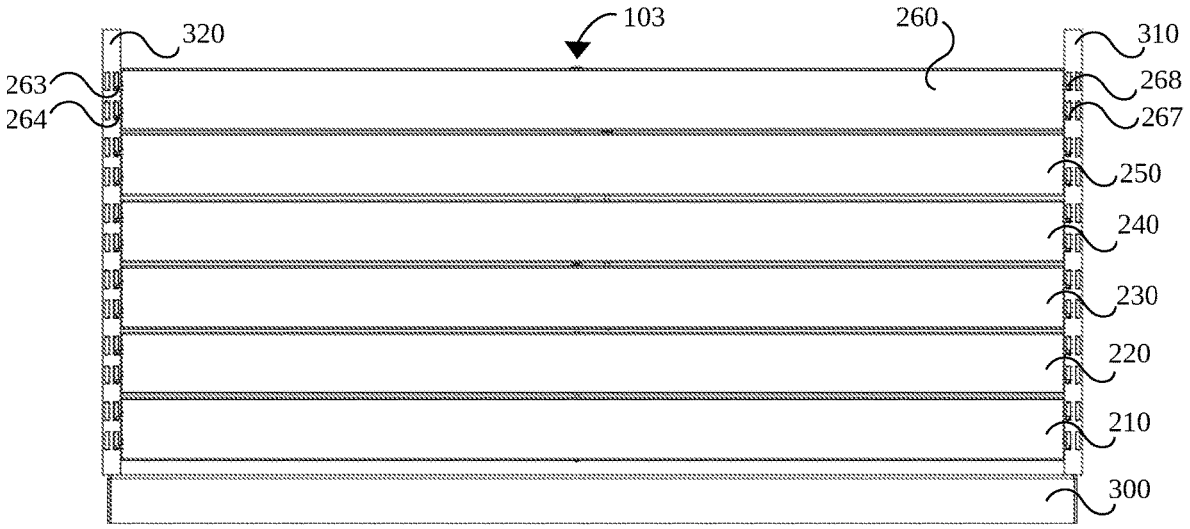
FIG. 2 is a front view of the cross-linked slatwall shelving system shown in FIG. 1.

Additional bases can be appended to the slatwall shelving system shown in FIG. 1, for example, in opposite side of the base 300 in reference to the posts to make a double-sided slatwall shelving system. The posts 310, 320 has symmetrical slots on both front and rear side so that additional slats can be installed facing the rear side as well. In addition, if desired, a slat on top 260 can be easily removed from top to have open space between the posts 310, 320 and the crossing rod 103 can be simply dropped through an empty hole on then-top slat 250. And this removal can be repeated to have desired open space between the posts 310, 320. In addition, any sequential bases to the slatwall shelving system shown in FIG. 1 can be added to next to the base 300 along the length, sharing either of the posts 310, 320. Then, an additional post is installed on the post-less end of the added base. The pair of slots at a same height on each side of the post 310, 320 allow the sequential installation with virtually no gap between bases or slots side-by-side.

Crossing rods 101, 102, 103 can be of different lengths, especially shorter to accommodate a short shelving unit. Also, a crossing rod with a thicker head can be made cheaply by pressing an end of a metal rod to form a flat, wider end while any other metalwork or manufacturing techniques can be used to form a wider end, including adding a cap or grip with non-metal material. Holes on slats can be perforated in any number and configuration along the length of a slat. For example, a slat may have a total of three holes on top side and three holes on bottom side in equal distance between adjacent two holes on the same side. In this configuration, the distance between two crossing rods penetrating a single slat maybe too far to create a strong cross-link, but it might be still desired when the width of a slatwall shelving unit is too short for two pairs of holes, total 8 top and bottom holes, but too long for a pair of holes, total 4 top and bottom holes. In another embodiment, the slats have different heights, but the same length of crossing rods can be used to form cross-link by allowing certain crossing rods to partially penetrate a slat.

Figure 7:
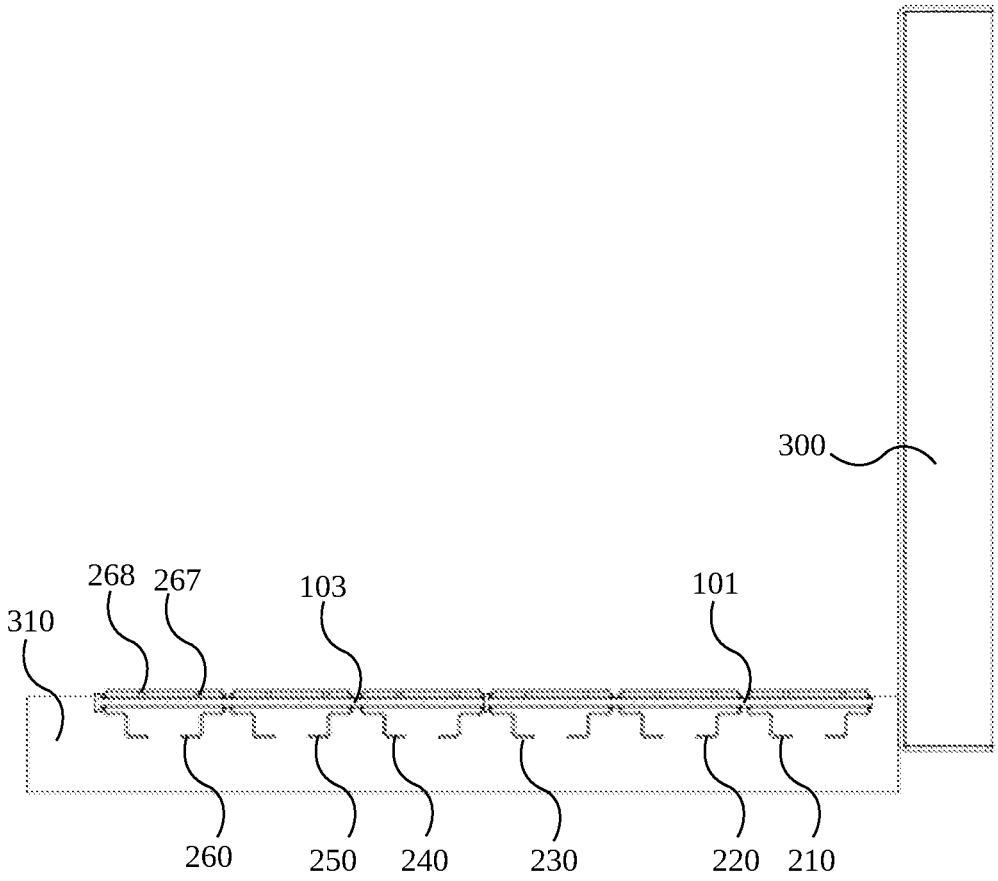
FIG. 7 is a sectional view of the cross-linked slatwall shelving system shown in FIG. 1 from the plane shown in FIG. 6.
Figure 8:
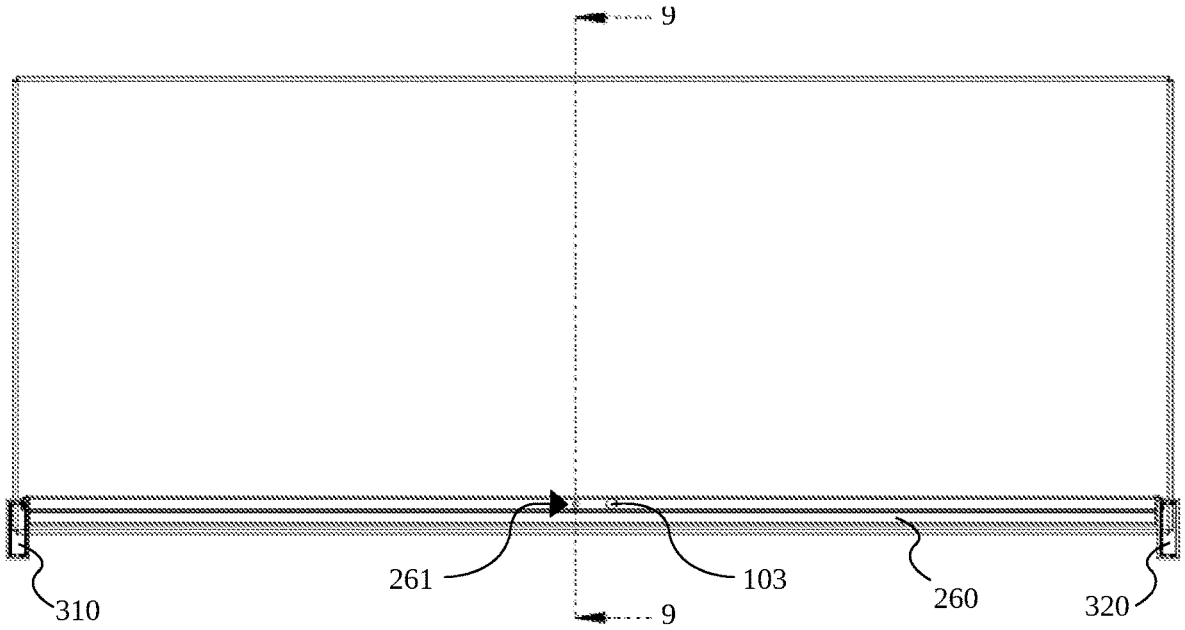
FIG. 8 is a top view of the cross-linked slatwall shelving system shown in FIG. 1.
Figure 9:
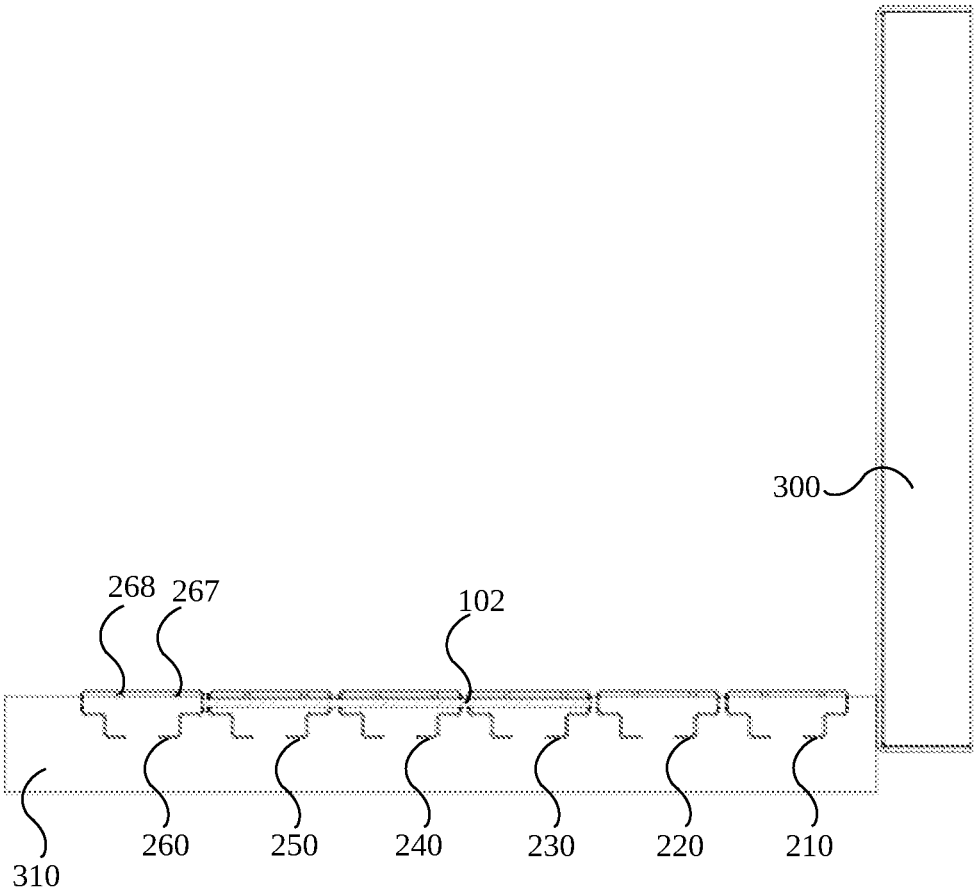
FIG. 9 is a sectional view of the cross-linked slatwall shelving system shown in FIG. 1 from the plane shown in FIG. 8.
Figure 10:
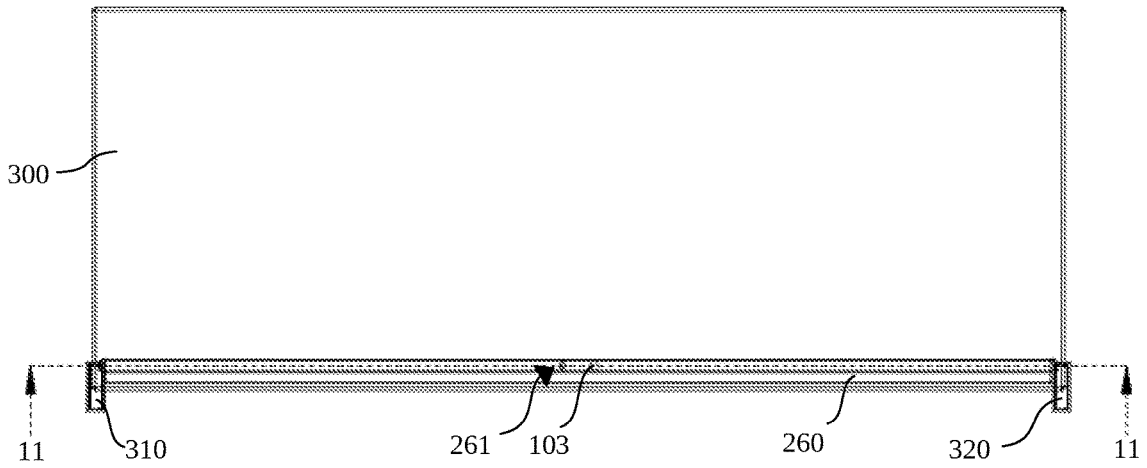
FIG. 10 is a top view of the cross-linked slatwall shelving system shown in FIG. 1.
Figure 11:
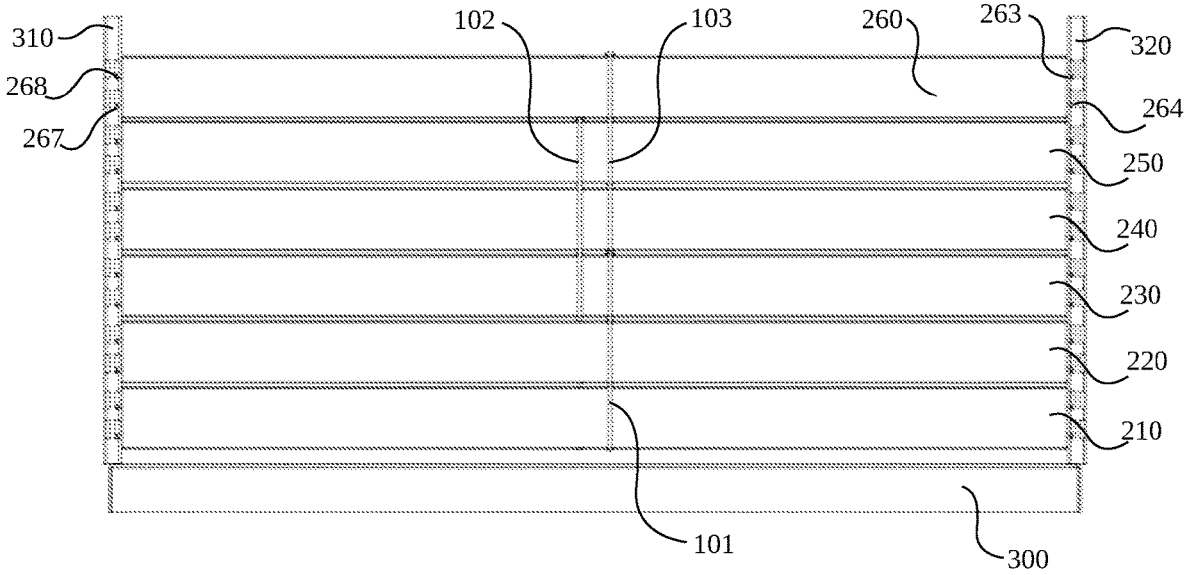
FIG. 11 is a sectional view of the cross-linked slatwall shelving system shown in FIG. 1 from the plane shown in FIG. 10.

A head of crossing rod 101 may have a cavity to receive the bottom end of another crossing rod 103 as illustrated in FIG. 7. The cavity in the head of crossing rod 101 secure the tip of crossing rod 103 against side-to-side movement and create a firmer and tighter cross-link for an added structural integrity of the slatwall shelving system.

Although preferable placement of holes is as close as possible to the front face of slats, crossing rods may be undesirably visible from the gaps between slats after installation. If needed, the gaps can be made smaller by either adjusting the number and configuration of slots on the posts 310, 320 or by adjusting the shape and placement of flanges 263, 264, 267, 268 attached on both ends of slats. Also, the holes can be perforated after the third right-angle bent of a slat which is the lower top surface or the higher bottom surface of the slat. The flanges can be economically made by cutting the sheet metal in the shape of outlines of flattened flanges, and later fold to form a flange 263, 264 in a right angle as shown in FIG. 12. Therefore, it is possible to have more than two flange cuts, among which only one or two are folded at a time for initial installation and later other sets of flange cuts are used for different configuration.

A person of ordinary skill would recognize that slatwall shelving system described herein has many additional structural benefits and physical characteristics arising out of common configuration used in retail stores and materials used for commercial and non-commercial shelving system, including but not limited to different backing type such as a pegboard and materials like aluminum and stainless steel, respectively. In fact, the gist of the invention lies with the use of crossing rods to cross-link plurality of flat panels, and thus the size and shape of the panels, rods, and holes are not limited to the embodiments described or shown herein.

The invention claimed is:

1. A slatwall shelving unit comprising:

a. a plurality of vertically stacked slats;

b. a first set of vertically aligned holes through the entire height of the plurality of vertically stacked slats;

c. a second set of vertically aligned holes through the entire height of the plurality of vertically stacked slats;

d. a first straight rod placed in a portion of the first set of vertically aligned holes, connecting one or more vertically stacked slats to form a first group of connected slats;

e. a second straight rod placed in a portion of the second set of vertically aligned holes, connecting one or more vertically stacked slats to form a second group of connected slats wherein a part of the first group of connected slats is connected by the second straight rod.

2. The shelving unit of claim 1 wherein:

a. the slats are made of carbon sheet steel cut and folded along right-angle bent lines to form a top side, bottom side, and flanges on both ends.

3. The shelving unit of claim 1 wherein:

a. the straight rods have a portion that is thicker than the diameter of a hole in the first and second sets of vertically aligned holes.

4. A method of constructing a slatwall shelving unit comprising:

a. placing two posts with multiple slots on a base upright;

b. placing a first group of slats consisting two or more slats with holes on top and bottom sides and flanges on both ends horizontally and sequentially by inserting the flanges into the slots on the posts from the slots closest to the bottom of the posts to the next closest slots;

c. inserting a straight rod vertically in a first set of vertically aligned holes in the first group of slats of the slats;

d. placing a second group of slats consisting one or more additional slats with holes on top and bottom sides and flanges on both ends horizontally and sequentially by inserting the flanges into the slots on the post from the slots closest to the first group of slats to the next closest slots; and e. inserting a second straight rod through a second set of vertically aligned holes in the second group of slats.

* * * * *